US006772535B2

(12) United States Patent
Koslow

(10) Patent No.: US 6,772,535 B2
(45) Date of Patent: Aug. 10, 2004

(54) HUMIDITY GENERATING SYSTEM AND METHOD AND USE IN WOOD DRYING KILN

(75) Inventor: Evan E. Koslow, Weston, CT (US)

(73) Assignee: Koslow Technologies Corporation, Orange, CT (US)

( * ) Notice: Subject to any disclaimer, the term of this patent is extended or adjusted under 35 U.S.C. 154(b) by 0 days.

(21) Appl. No.: 10/167,252

(22) Filed: Jun. 10, 2002

(65) Prior Publication Data

US 2003/0226277 A1 Dec. 11, 2003

(51) Int. Cl.[7] ..... F26B 7/00
(52) U.S. Cl. ..... 34/380; 34/225; 34/218
(58) Field of Search ..... 34/380, 396, 76, 34/218, 219, 225

(56) References Cited

U.S. PATENT DOCUMENTS

| | | | | |
|---|---|---|---|---|
| 2,064,650 A | | 12/1936 | Emanueli | |
| 2,258,445 A | | 10/1941 | Coopey | |
| 2,507,797 A | | 5/1950 | Martin | |
| 2,869,838 A | | 1/1959 | Ryder | |
| 2,908,346 A | | 10/1959 | Cornell | |
| 3,604,124 A | | 9/1971 | Leeds et al. | 34/23 |
| 4,490,926 A | | 1/1985 | Stokes | 34/76 |
| 4,604,109 A | | 8/1986 | Koslow | |
| 4,643,852 A | | 2/1987 | Koslow | 261/93 |
| 4,833,895 A | | 5/1989 | Johnson | |
| 5,348,691 A | | 9/1994 | McElroy et al. | 261/36.1 |
| 5,714,543 A | * | 2/1998 | Shah et al. | 525/123 |
| 5,836,086 A | | 11/1998 | Elder | 34/396 |
| 6,309,508 B1 | | 10/2001 | Lemme et al. | |
| 6,503,448 B1 | | 1/2003 | Kuhfeldt et al. | 422/11 |
| 2002/0025583 A1 | | 2/2002 | Ellsworth et al. | 436/514 |
| 2002/0055703 A1 | | 5/2002 | Mori et al. | 604/20 |

* cited by examiner

*Primary Examiner*—Henry Bennett
*Assistant Examiner*—Camtu Nguyen
(74) *Attorney, Agent, or Firm*—Shirley S. Ma

(57) ABSTRACT

An apparatus and method for generating water vapor or humidity, useful in a variety of applications, including a wood drying kiln. The apparatus may contain a hydrophilic disk, a water supply structure that supplies water so that the water is deposited on the hydrophilic disk, and a motor for rotating the disk at a speed sufficiently high so that water which is deposited on the disk is caused to leave the disk in the form of a mist of particles or droplets which are sufficiently small to evaporate rapidly to generate the water vapor. The disk may be made hydrophilic by covering with a fabric.

27 Claims, 3 Drawing Sheets

HUMIDITY GENERATING SYSTEM AND METHOD AND USE IN WOOD DRYING KILN

BACKGROUND OF THE INVENTION

1. Field of the Invention

The present invention relates to a system and a method used for generating water vapor so as to provide a controlled humidity environment. More particularly, it relates to an apparatus and method which may have, among other applications, the control of humidity in a wood drying kiln.

2. Prior Art

Lumber drying kilns put 20,000 to 100,000 board feet (or more) of various species of lumber, with various dimensions in the kiln, and then heat the closed kiln to between 1000 and 1800 Fahrenheit (approximately 380 to 820 Celsius) for many days to extract moisture from wood. Thicker pieces of harder wood take longer to dry, sometimes up to 45 days (or longer). A major difficulty in drying wood is that the surface of the wood dries out more quickly than the center of a given piece. The result is checking, cracking, crazing or warping of the wood surface. Since surface clarity is the selling feature for cost of the dried wood, the value of the wood is greatly diminished or reduced to zero due to such checking, cracking, crazing or warping.

In general, the normal approach used in a wood drying kiln is to gradually increase the temperature, while controlling the moisture levels in the kiln using the differential between wet bulb and dry bulb temperature sensors.

The benefits of controlling humidity in the kiln include maintaining a given drying schedule and obtaining surfaces with no checking, cracking, crazing or warping, or shortening the processing or drying time. The higher temperatures allow shorter drying periods for reaching the desired 6 to 8% moisture levels of dried wood by maintaining the humidity at a higher level when higher temperatures are used.

A conventional approach for maintaining higher humidity is to use hot steam in the kiln. However, the use of steam often raises the dry bulb temperature of the kiln at too high a rate. Further many plants do not have sufficient steam capacity to provide the required amount of steam. Typically a plant has a given boiler, and over the course of many years has added several kilns. There is enough steam available to dry the wood, but not enough to condition it by controlling the humidity level.

Most boilers used in the kiln drying industry are rated to provide steam at 15 lbs. per square inch. A general rule is that five BTU of steam energy are needed per board foot per hour for conditioning. Typically, in a seven day drying cycle the first two days dry off the surface water (or ice). After that, for the next four to five days, moisture is added to the kiln to prevent the checking. As an example, in a 30,000 board foot kiln, the amount of steam required at 5 BTU/board foot times 30,000 board feet equals 150,000 BTU per hour, or approximately five horsepower continuously.

Another approach is to use high-pressure steam to inject atomized water into the kiln. This method is expensive and requires energy for the boiler to produce or atomize the moisture, while keeping the dry bulb temperature from dropping.

A variety of approaches have been suggested for vaporizing liquids. For example, U.S. Pat. No. 4,604,109 by Koslow discloses an apparatus for separating contaminants from a fluid using a vacuum chamber and at least one rotating plate disposed within the chamber. The contaminated fluid is flung off the rotating disk in the form of a fine mist of droplets from which the contaminants evaporate. The purified droplets are then collected.

U.S. Pat. No. 4,833,895 to Johnson discloses a spin disk evaporator including a pan suspended from a cage enclosing a motor rotating a spin disk and a fan for moving an air stream across the pan and outward for the evaporator. The disk includes a cone-shaped tip immersed in water held in a sump portion of the pan. Rotation of the disk causes a film of water to be picked up by the tip and moved across the water transfer surface in a circumferential wall of the disk. Water collected on the inner surface of the wall separates and moves through grooves from the inner surface of the wall across the end of the wall to the outer surface. Water exits from the grooves and a circular head and is dispersed into the air stream as extremely fine water particles.

The approaches outlined above do not provide an apparatus or method for producing large quantities of water vapor in an inexpensive and efficient manner. Further, these approaches do not provide any suggestion of the manner in which water vapor can be produced efficiently and inexpensively for use in a wood drying kiln.

SUMMARY OF THE INVENTION

It is an object of the invention to provide an apparatus and a method to readily generate water vapor efficiently and inexpensively.

It is another object of the invention to use the generated water vapor to control the humidity in an apparatus such as a wood drying kiln.

It is a further object of the invention to prevent the occurrence of undesirable defects in wood such as checking, cracking, crazing or warping, by inexpensively and efficiently controlling the humidity in a wood drying kiln.

The invention is directed to an apparatus for generating water vapor comprising at least one hydrophilic disk; a water supply structure for supplying water so that the water is deposited on the at least one disk; and means for rotating at least one disk at a speed sufficiently high so that water, which is deposited thereon is caused to leave at least one disk in the form of a mist or aerosol of very small water particles which evaporate to generate the water vapor (humidity).

A disk in accordance with the invention may comprise a water absorbing fabric affixed to the disk. An adhesive layer, such as an epoxy, may be disposed between the disk and the fabric for bonding the fabric to the disk. The fabric may be one of a woven and a non-woven fabric, and may be comprised of a material selected from the group consisting of a polyester, a cotton and a cellulose. Alternatively, a layer of a phosphate may be disposed on the disk so as to render the disk hydrophilic.

The disk or disks may be rotated by an electric motor, a hydraulic motor or a pneumatic motor. The disk or disks may be directly attached to the shaft of the motor. The apparatus may be combined with a wood drying kiln, the apparatus being placed within the kiln to provide a source of water vapor as the temperature of the kiln is controlled to dry wood placed in the kiln.

The invention is also directed to a method for providing water vapor, comprising rotating at least one hydrophilic disk at speeds sufficiently high to fling a fine mist of water particles from the disk; and providing water to said at least one disk.

Another aspect of the invention is a method of drying wood in a kiln, comprising heating air in the kiln; adding water vapor to the air by providing water to at least one hydrophilic disk, rotating the disk or disks at speeds sufficiently high to generate a mist of fine water particles, and circulating the air to which water vapor has been added to dry the wood. This method may be thought of as lumber conditioning; that is the process used to relieve stresses that build up in lumber as a result of drying of the lumber.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
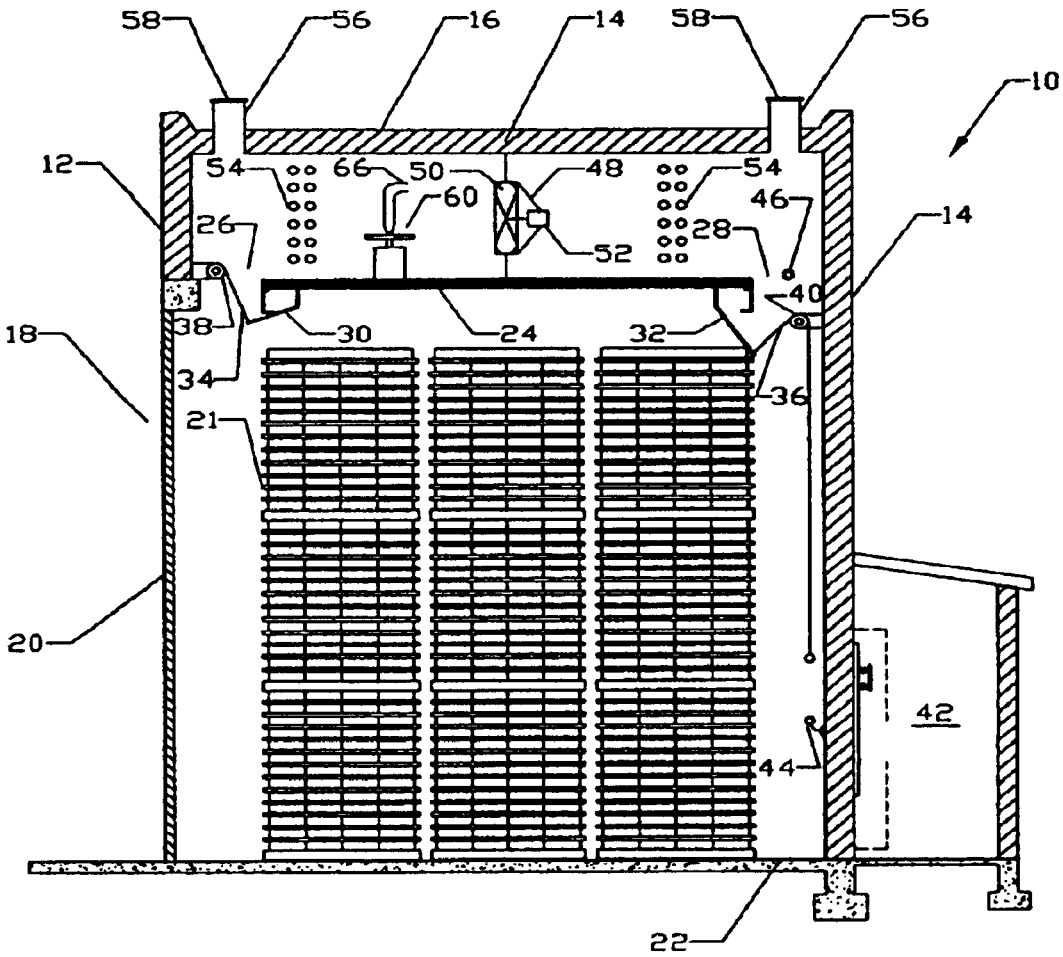
FIG. 1 is a cross-sectional view of a wood drying kiln in accordance with the invention.

Referring to FIG. 1, there is shown a cross-sectional view of a wood drying kiln 10 incorporating features of the present invention. Kiln 10 is of the package loaded type, although the present invention may be applied to various other types of kilns such as, for example, a lineshaft, double track, compartment kiln, or to applications other than kilns. Although the present invention will be described with reference to the single embodiment shown in the drawing, it should be understood that the present invention can be embodied in many alternate forms of embodiments. In addition, any suitable size, shape or type of elements or materials could be used.

Kiln 10 has a generally rectangular housing defined by insulated walls 12 and 14, and an insulated roof 16, the insulation being necessary to keep heat contained therein. A doorway 18 having a movable door 20 through which wood packages 21 may be placed into and removed from kiln 10 is provided. The wood is supported on a floor 22, generally of concrete. A fan deck 24, having air circulation openings 26 and 28, together with walls 12 and 14 define a plenum chamber through which hot air is circulated to dry the wood placed therein. Openings 26 and 28 have respective heat control baffle 30 and vent baffle 32, the positions of which are controlled by respective ropes 34 and 36, routed over respective pulleys 38 and 40.

As well known in the art, a control room 42 is provided for housing control and process condition recording equipment. A so called wet bulb temperature sensor 44 is used to generate a signal from which is derived a control for the position of vent 32, while a so called dry bulb temperature sensor 46 is used to generate a signal from which is derived a control for the position of heat control baffle 30. A fan 48 having a large diameter blade assembly 50, typically on the order of thirty six to seventy two inches (91.4 cm to 182.9 cm) in diameter, which is turned by a motor 52, is used to circulate the air in kiln 10. The air is heated by steam containing tubes or pipes 54. Air chimneys 56 with automatic vents 58 are provided in roof 16. The operation of the fan 48, heat control baffles 30 and vent baffle 32, and the amount of steam circulated through pipes 54, and other aspects of the drying process in kiln 10 (including periodic reversal of the direction of air flow by reversing the direction or rotation of motor 52), are controlled by suitable control devices in control room 42.

Figure 2:
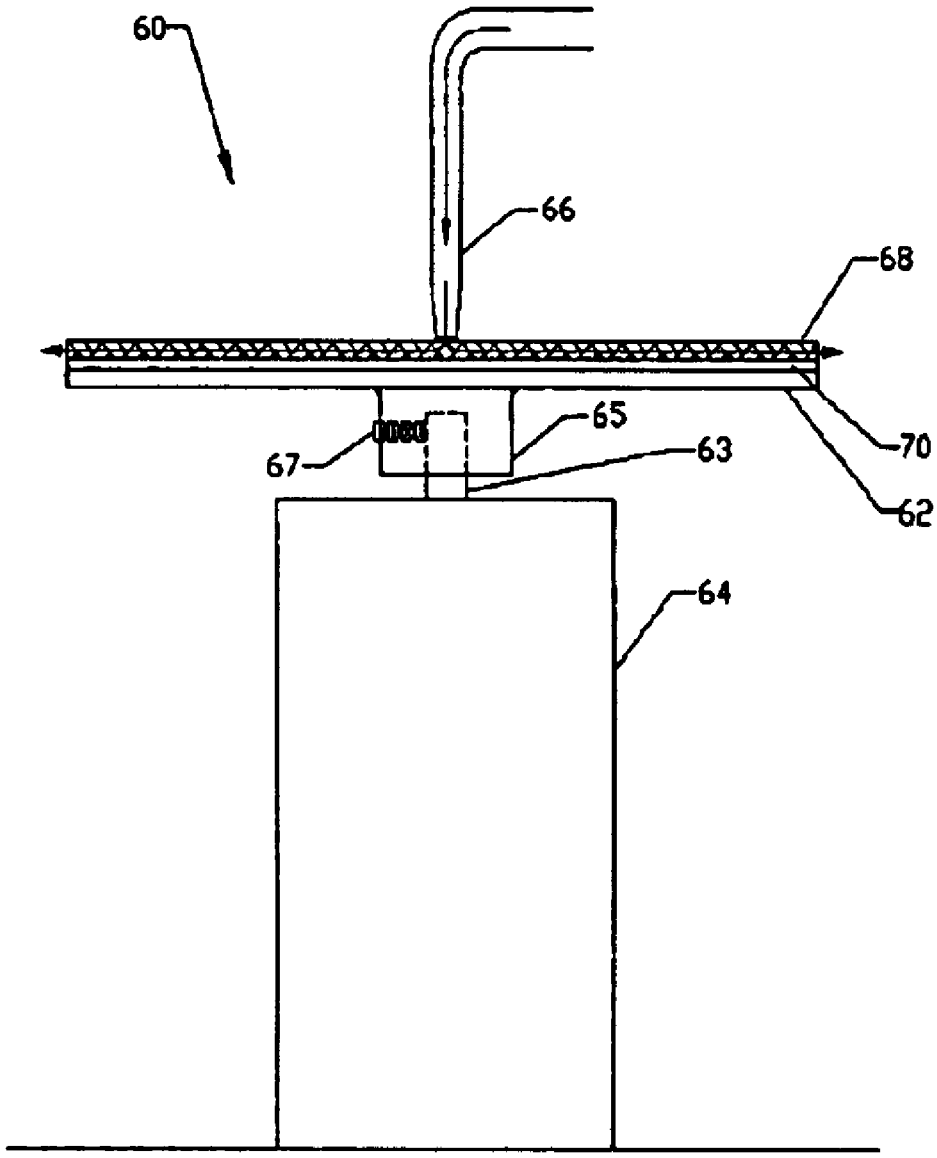
FIG. 2 is a side elevational view of the humidifying apparatus, in accordance with the invention, of FIG. 1.

Referring to FIG. 2, in accordance with the present invention, instead of spraying steam into the fan deck region of kiln 10, a humidifying apparatus 60 in accordance with the invention is used. A disk 62, mounted for rotation therewith on the shaft 63, of a motor 64, is caused to rotate at a high rate, such as 3600 rpm. Motor 64 may be electrically, hydraulically, mechanically or pneumatically driven (or may be driven by any other equivalent means). A hub 65, configured to receive shaft 63 and affixed thereto by any of several well known techniques, including at least one set screw 67, may be welded to disk 62 in a manner which does not distort disk 62. A source of water, such as a feed pipe 66, drops water directly onto the spinning disk, at its center, or as close to the center as possible. The water feed to apparatus 60 by pipe 66 may be controlled by a relative humidity sensor (not shown), or wet bulb temperature sensor, so that water is supplied only when the humidity falls below a predetermined or preprogrammed level, which may vary with time, as the wood is dried. The water is caused, by centrifugal force, to be directed toward the outer circumference of disk 62, where it is desired that it be flung therefrom in the form of a fine mist of water particles, in the order of 5 to 20 microns in diameter. In fact, the relationship that defines the size of droplets is explained in the above mentioned U.S. Pat. No. 4,604,109 to Koslow.

A problem that may occur is that the water may not wet the surface of disk 62, which may be formed of a stainless steel to assure adequate strength and corrosion resistance. In this case, the water will bounce off at positions other than the rim, and will not be adequately vaporized. This will result in less than the proper humidity being maintained, which may cause the abovementioned defects of checking, cracking or crazing to occur.

In accordance with the present invention, disk 62 is hydrophilic. Disk 62 may have a hydrophilic coating or layer placed thereon to assure that the water wets the disk 62, or is absorbed thereon, so that it may be carried to the outer periphery of disk 62 in a controlled manner before being propelled therefrom.

While a very thin layer of a phosphate may be deposited on disk 62 to enhance surface wetting, there is a tendency for this surface layer to wear off in a relatively short time with use. While this approach is of value for some applications, it requires frequent maintenance. For example, it may be necessary to have spare disks and to change the disks in order to keep a process running. Such interruption or lack of continuity may be undesirable in some processes, such as the wood drying process described herein, and adds to costs, in terms of lost time and the requirement for an additional inventory of parts.

Also in accordance with the invention, these difficulties may be avoided by affixing a hydrophilic layer 68, such as a hydrophilic, non-woven fabric, to the surface (generally the upper surface) of disk 62 on to which the water is caused to flow. Layer 68 may be affixed to the surface of disk 62 with a layer 70 of an adhesive, such as, for example, an epoxy resin. To assemble the fabric to disk 62, first the surface thereof is suitably prepared, by for example scoring, so that the epoxy will readily adhere thereto. Then, a thin layer 70 of the epoxy is applied to the surface of disk 62. A piece of fabric 68 larger than the size of disk 62 is then stretched over disk 62. Epoxy layer 70 is then allowed to set. Excess fabric extending beyond the circumference of disk 62 is then trimmed off, by use of a suitable cutting implement. If necessary, disk 62 may be spin balanced, for example by placement of suitable weights (not shown) placed at locations about its circumference, on the side opposite that of fabric 68 (the underside), in a manner well known in the art, to prevent undesirable vibrations which may adversely effect the life of bearings that support motor shaft 63.

Figure 2A:
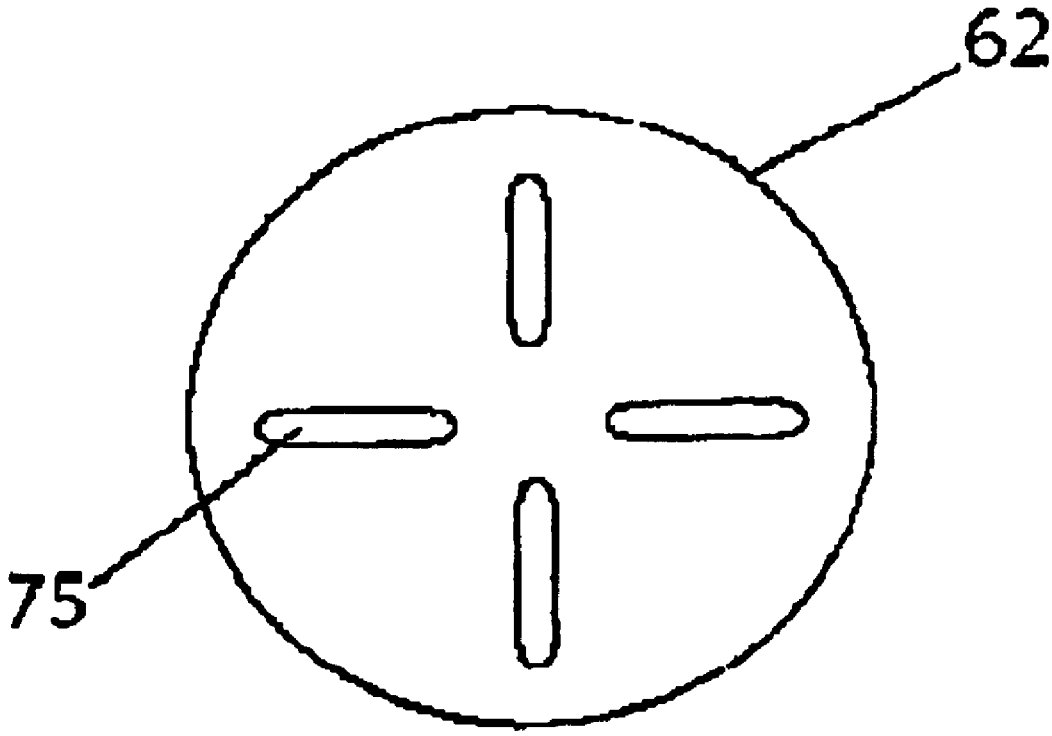
FIG. 2A is a top plan view of a hydrophilic disk having radially extending grooves useful in the humidifying apparatus, in accordance with the present invention.

By hydrophilic, it is meant that disk 62 takes in water so that the water does not bounce off the disk 62 without being vaporized. The water is then available to be conducted to the edge of disk 62, and leaves the rotating disk in the form of a very fine mist. It will ha recognized that structures other than those shown herein may achieve the same result. For example, disk 62 may be configured as a sandwich structure or assembly with a top and bottom plate, and the top plate having a central opening for receiving water. A hydrophilic material may be disposed between the two plates to receive the water and to conduct the water to the periphery of the assembly. Alternatively, disk 62 may be machined with a series of preferably deep, radially extending grooves to receive the water and to conduct the water to its periphery, as shown in FIG. 2A. This disk may be the lower one of the sandwich type structure discussed above.

EXAMPLE

Disk 62 may have a diameter of approximately 10 inches (25.4 cm) and a thickness of approximately 0.2 inch (0.5 cm). A non-woven fabric made of a hydrophilic material or a woven cloth, such as one made from cotton may be adhered to disk 62 by a water resistant epoxy, of a type well known in the art. The disk 62 may be rotated at 3600 rpm by a totally enclosed, fan cooled, fractional horsepower motor of a type well known in the art, suitable for high temperature applications. Such motors are readily available from a number of manufacturers. At this speed of rotation, the mist formed will be distributed about a theoretical particle diameter of approximately 18 microns. This distribution will be maintained as long as the rate at which water is deposited on disk 62 does not significantly approach a maximum rate $Q_{(max)}$ defined in the abovementioned U.S. Pat. No. 4,604,109 to Koslow. In this example $Q_{(max)}$ is approximately 10 gallons (40 liters) per minute.

Such small water particles (or small droplets which may be characterized as an aerosol) evaporate at an extremely rapid rate, especially in the heated environment of a wood drying kiln. While such evaporation may cause some cooling, and additional heat may be needed to maintain a drying temperature program, the situation is fail-safe, in that a slightly lower temperature will not damage the wood, because it will not contribute to the creation of the checking, cracking, crazing or warping mentioned above.

In accordance with the size of the kiln, more water vapor may be required than can be supplied by a single rotating disk. Several assemblies as described herein may be utilized, as required. In addition or alternatively, with suitable selection of motor size, as described in the above mentioned patent to Koslow, multiple disks may be mounted on a single shaft, and each disk supplied with water to be vaporized.

Depending upon the particular application of the apparatus in accordance with the invention, the diameter of the rotating disk may be varied. Disk sizes much smaller and much larger than the example set forth herein may be used, with constraints imposed by the fineness of the mist that is to be generated, as set forth in the above mentioned patent to Koslow.

It may also be desirable to provide protection against motor failure or an interruption in the supply of electricity to an electric motor used to rotate the disk, which could lead to water being dropped on the fan deck if the motor were not spinning to vaporize the water. This can be avoided by placing an electrically operated valve (not shown) in the water supply system to automatically shut down the flow of water if the motor speed drops or if the motor stops. A centrifugal switch (not shown), such as those used to switch motor start windings (that close when the motor is operating below a predetermined rotational speed) can be used to provide an appropriate control signal, with modifications to open below such speed and remove the electrical supply to a normally closed electrically operated water supply valve.

In most cases, it is recommended that an anion/cation water softener be used to remove hardness and heavy metals, such as iron, for the local water supply that is used to provide water to the apparatus in accordance with the invention.

Thus, the present invention provides superior product control, as there is no staining due to the deposit of moisture droplets upon the wood that is being processed. Maintenance requirements are greatly reduced as there are no steam injection nozzles to clean. Further, the ability to accurately control moisture, or relative humidity, with no steam related temperature increase allows more precise and reliable control, resulting in shorter, more effective conditioning time periods. The rotating disk typically ejects water particles of less than 20 microns in size at a speed of 140 mph (226 kph). These particles immediately vaporize, thus providing humidity at ambient kiln temperature. This is done with low energy use.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for providing water vapor comprising:

rotating at least one hydrophilic disk at speeds sufficiently high to fling a mist of water from the at least one hydrophilic disk wherein the at least one hydrophilic disk has a plurality of radially extending grooves for conducting water to a periphery of the at least one hydrophilic disk; and providing water to the at least one disk.

2. An apparatus for substantially continuous generation of water vapor comprising:

at least one hydrophilic disk including a water absorbing fabric affixed to said at least one hydrophilic disk a water supply structure for supplying water so that the water is deposited on said at least one hydrophilic disk; and a means for rotating said at least one hydrophilic disk at a speed sufficiently high so that water that is deposited on said at least one hydrophilic disk is caused to leave said at least one hydrophilic disk in the form of particles that evaporate to generate water vapor.

3. The apparatus of claim 2 further including an adhesive layer disposed between said at least one hydrophilic disk and the water absorbing fabric for bonding the water absorbing fabric to said at least one hydrophilic disk.

4. An apparatus for generating water vapor comprising:

at least one hydrophilic disk;

a water absorbing fabric affixed to said at least one hydrophilic disk; an adhesive layer disposed between said at least one hydrophilic disk and said water absorbing fabric for bonding said water absorbing fabric to said at least one hydrophilic disk, wherein said adhesive layer comprises a cured epoxy;

a water supply structure for supplying water so that the water is deposited on said at least one hydrophilic disk; and means for rotating said at least one hydrophilic disk at a speed sufficiently high so that water which is deposited on said at least one hydrophilic disk is caused to leave said at least hydrophilic one disk in the form of particles which evaporate to generate water vapor.

5. The apparatus of claim 4, wherein the fabric is one of a woven and a non-woven fabric.

6. The apparatus of claim 4, wherein the fabric is formed from a material selected from the group consisting of a polyester, a cotton and a cellulose.

7. An apparatus for generating water vapor comprising:

at least one hydrophilic disk;

a layer of a phosphate disposed on said at least one disk so as to render the disk hydrophilic;

a water supply structure for supplying water so that the water is deposited on said at least one disk; and means for rotating the at least one disk at a speed sufficiently high so that water which is deposited on said disk or disks is caused to leave said disk or disks in the form of particles which evaporate to generate said water vapor.

8. The apparatus of claim 4 or 7, wherein said means for rotating said at least one disk comprises one of an electric motor, a hydraulic motor and a pneumatic motor.

9. The apparatus of claim 4 or 7, wherein said means for rotating said at least one disk comprises an electric motor, and said at least one disk is directly coupled to a shaft of said motor.

10. The apparatus of claim 4 or 7, in combination with a wood drying kiln, said apparatus being placed within said kiln to provide a, source of water vapor as temperature of said kiln is controlled to dry wood placed in said kiln.

11. A method for providing water vapor, comprising:

rotating at least one hydrophilic disk at speeds sufficiently high to fling a mist of water from said at least one disk, the at least one hydrophilic disk comprising: a water absorbing fabric affixed to the at least one hydrophilic disk, and an adhesive layer comprising a cured epoxy disposed between the at least one hydrophilic disk and the water absorbing fabric for bonding the water absorbing fabric to the at least one hydrophilic disk; and providing water to said at least one disk.

12. The method of claim 11, wherein the at least one hydrophilic disk comprises a water absorbing fabric affixed to the disk.

13. The method of claim 12, wherein the fabric is one of a woven and a non-woven fabric.

14. The method of claim 12, wherein the fabric is formed from a material selected from the group consisting of a polyester, a cotton and a cellulose.

15. A method for providing water vapor, comprising:

rotating at feast one hydrophilic disk at speeds sufficiently high to fling a mist of water from the at least one disk wherein the at least one disk comprises a layer of a phosphate disposed on the at least one disk so as to render the at least one disk hydrophilic; and providing water to the at least one disk.

16. A method of drying wood in a kiln, comprising:

heating air in said kiln;

adding water vapor to said air by providing water to at least one hydrophilic disk having a water absorbing fabric affixed to said at least one hydrophilic disk, and an adhesive layer comprising a cured epoxy disposed between said at least one hydrophilic disk and said water absorbing fabric for bonding said water absorbing fabric to said at least one hydrophilic disk;

rotating said at least one disk at a speed sufficiently high to fling a mist of water from said disk, and circulating the air to which water vapor has been added as the wood is dried.

17. A method for providing water vapor comprising:

rotating at least one hydrophilic disk at speeds sufficiently high to fling a mist of water from the at least one hydrophilic disk wherein the at least one hydrophilic disk has a top plate having an opening for receiving water, a bottom plate, and a hydrophilic material disposed between the top plate and the bottom plate for receiving the water and to conduct the water to a periphery of each disk; and providing water to the at least one disk.

18. The method of claim 16, wherein the fabric is a non-woven fabric.

19. The method of claim 16, wherein the fabric is formed from a material selected from the group consisting of a polyester, an acrylic and a cellulose.

20. A method drying wood in a kiln, comprising:

heating air in the kiln;

adding water vapor to the air by providing water to at least one hydrophilic disk and rotating the at least one disk at a speed sufficiently high to fling a mist of water from the at least one disk, wherein the at least one disk comprises a layer of a phosphate disposed on the at least one disk so as to render the at least one disk hydrophilic; and circulating the air to which water vapor has been added as the wood is dried.

21. An apparatus for generating water vapor comprising:

at least one hydrophilic disk, each disk having a top plate having an opening for receiving water, a bottom plate, and a hydrophilic material disposed between the top plate and the bottom plate for receiving the water and to conduct the water to a periphery of each disk;

a water supply structure for supplying water so that the water is deposited on said at least one hydrophilic disk; and means for rotating said at least one hydrophilic disk at a speed sufficiently high so that water which is deposited on said at least one hydrophilic disk is caused to leave said at least hydrophilic one disk in the form of particles which evaporate to generate water vapor.

22. The apparatus of claim 21, wherein the hydrophilic material is one of a woven and a nonwoven fabric.

23. The apparatus of claim 21, wherein the hydrophilic material is formed from a material selected from the group consisting of a polyester, a cotton, and a cellulose.

24. The apparatus of claim 21, further comprising an adhesive layer disposed between the hydrophilic material and the bottom plate.

25. An apparatus for generating water vapor comprising:

at least one hydrophilic disk, each disk having a top plate having an opening for receiving water, a bottom plate having a plurality of radially extending grooves, and a hydrophilic material disposed between the top plate and the bottom plate for receiving the water and to conduct the water to a periphery of each disk;

a water supply structure for supplying water so that the water is deposited on said at least one hydrophilic disk; and means for rotating said at least one hydrophilic disk at a speed sufficiently high so that water which is deposited on said at least one hydrophilic disk is caused to leave said at least hydrophilic one disk in the form of particles which evaporate to generate water vapor.

26. An apparatus for generating water vapor comprising:

at least one hydrophilic disk having a plurality of radially extending grooves;

a water supply structure for supplying water so that the water is received in the plurality of radially extending grooves and is conducted to a periphery of said at least one hydrophilic disk; and means for rotating said at least one hydrophilic disk at a speed sufficiently high so that water which is deposited on said at least one hydrophilic disk is caused to leave said at least hydrophilic one disk in the form of particles which evaporate to generate water vapor.

27. The apparatus of claim 26 wherein said at least one hydrophilic disk further includes a layer of phosphate disposed on said at least one hydrophilic disk.

* * * * *